US007549770B2

(12) United States Patent
Devaney et al.

(10) Patent No.: US 7,549,770 B2
(45) Date of Patent: Jun. 23, 2009

(54) MODULE FOR A FLASHLIGHT OR LANTERN

(75) Inventors: John P. Devaney, Mountain Top, PA (US); Mark F. Dirsa, Shavertown, PA (US)

(73) Assignee: Koehler-Bright Star, Inc., Hanover Township, PA (US)

( * ) Notice: Subject to any disclaimer, the term of this patent is extended or adjusted under 35 U.S.C. 154(b) by 67 days.

(21) Appl. No.: 11/535,428

(22) Filed: Sep. 26, 2006

(65) Prior Publication Data

US 2008/0030979 A1 Feb. 7, 2008

Related U.S. Application Data

(60) Provisional application No. 60/821,034, filed on Aug. 1, 2006.

(51) Int. Cl.
*F21V 33/00* (2006.01)

(52) U.S. Cl. ..... 362/253; 362/190; 362/191; 362/200; 362/208

(58) Field of Classification Search ..... None
See application file for complete search history.

(56) References Cited

U.S. PATENT DOCUMENTS

| | | | | |
|---|---|---|---|---|
| 1,394,101 | A | 10/1921 | Little | |
| 2,231,382 | A | 2/1941 | Desimone | |
| 2,370,150 | A | 2/1945 | Dircksen | |
| 2,538,332 | A | 1/1951 | Schaefer | |
| 2,900,493 | A | 8/1959 | Cheng | |
| 2,934,635 | A | 4/1960 | Cheng | |
| 2,983,812 | A | 5/1961 | Ashe | |
| 3,003,057 | A | 10/1961 | Cheng | |
| 3,030,497 | A | 4/1962 | Cheng | |
| 3,609,344 | A | 9/1971 | So | |
| 3,944,805 | A | 3/1976 | Moore | |
| 3,982,120 | A | 9/1976 | Wynn | |
| 4,228,484 | A | 10/1980 | Johnstone | |
| 4,447,863 | A | 5/1984 | Fenne | |
| 5,117,341 | A | 5/1992 | Huang | |
| D337,840 | S | 7/1993 | Ekeroth | |
| 5,422,799 | A | 6/1995 | Morrison, Sr. | |
| 5,428,514 | A | 6/1995 | Fink, Jr. | |
| 5,455,751 | A | 10/1995 | Lynch et al. | |
| D370,734 | S | 6/1996 | Lynch et al. | |
| D373,436 | S | 9/1996 | Li et al. | |
| 5,558,430 | A * | 9/1996 | Booty, Jr. | 362/184 |
| D375,375 | S | 11/1996 | Poon | |
| 5,655,308 | A | 8/1997 | McDermott | |
| 5,704,706 | A | 1/1998 | Goldston et al. | |
| 5,909,952 | A | 6/1999 | Guthrie et al. | |
| 6,017,129 | A | 1/2000 | Krietzman | |
| 6,186,634 | B1 * | 2/2001 | Pitts | 362/84 |
| 6,206,541 | B1 | 3/2001 | Landamia | |
| 6,260,985 | B1 | 7/2001 | Zeller | |

(Continued)

*Primary Examiner*—Laura Tso
(74) *Attorney, Agent, or Firm*—DLA Piper LLP (US); R. Blake Johnston

(57) ABSTRACT

A flashlight or lantern having a separate modular component that is preferably powered by the flashlight or lantern power source and is mounted within a pocket or recess on the outer surface of the body of the flashlight or lantern. The module can be a secondary lighting source or a device such as a tracking mechanism or GPS receiver. The module can be semi-permanently or detachably mounted to the flashlight or lantern.

18 Claims, 3 Drawing Sheets

U.S. PATENT DOCUMENTS 6,296,370 B1 * 10/2001 Bamber et al. ..... 362/190
6,623,139 B1 9/2003 Gutmann
6,623,140 B2 * 9/2003 Watterson et al. ..... 362/184

* cited by examiner

MODULE FOR A FLASHLIGHT OR LANTERN

CROSS-REFERENCE TO RELATED APPLICATIONS

This application claims the benefit of U.S. Provisional Application No. 60/821,034, filed Aug. 1, 2006, which is hereby incorporated by reference in its entirety.

FIELD OF INVENTION

The field of invention relates to powered flashlights, lanterns, and other lights and more specifically to an interchangeable module powered by the flashlight.

BACKGROUND

The use of secondary lighting sources on a powered flashlight or lantern is well known in the art. One can certainly replace one light bulb for another in incandescent versions of such powered flashlights or lanterns. However, if the secondary light source requires replacement of its functional components, apart from a bulb, often times the flashlight or lantern is not configured for ready replacement or repair of the secondary light source.

SUMMARY OF INVENTION

Our invention includes:

In one embodiment, a flashlight comprising a body having an outer surface; a power source preferably located within said body; and a module, wherein said module is contiguous to said outer surface and said module receives power from said power source. Preferably, the module is removably attached and/or is selected from the group consisting of a lighting module, a GPS navigation module, a tracking module, a natural gas detection module, and a radio module.

In another embodiment, a flashlight comprising a body having an outer surface; and a module comprising a power source located within said module, wherein said module selected from the group consisting of an LED lighting module, a GPS navigation module, a tracking module, and a natural gas detection module, and wherein said module is contiguous to said outer surface.

In another embodiment, a flashlight comprising a body having an outer surface; a primary lamp contiguous to said body; and a power take-off, wherein said power take off is contiguous to said outer surface and comprises an electrical cord attached to said power take off.

BRIEF DESCRIPTION OF THE DRAWINGS

Embodiments of the invention have been chosen for purposes of illustration and description, and are shown in the accompanying drawings, forming a part of the specification wherein.

DETAILED DESCRIPTION OF PREFERRED EMBODIMENTS

As used herein, "flashlight" includes, but is not limited to, any flashlight, lantern, spotlight or similar illumination device known in the art.

In one preferred embodiment, a flashlight comprises a body having an outer surface; a power source (preferably located within said body); and a module, wherein said module is contiguous to said outer surface and said module receives power from said power source.

In another preferred embodiment, a flashlight comprises a body having an outer surface; and a module comprising a power source located within said module, wherein said module is selected from the group consisting of an LED lighting module, a GPS navigation module, a tracking module, and a natural gas detection module, and wherein said module is contiguous to said outer surface.

Figure 1:
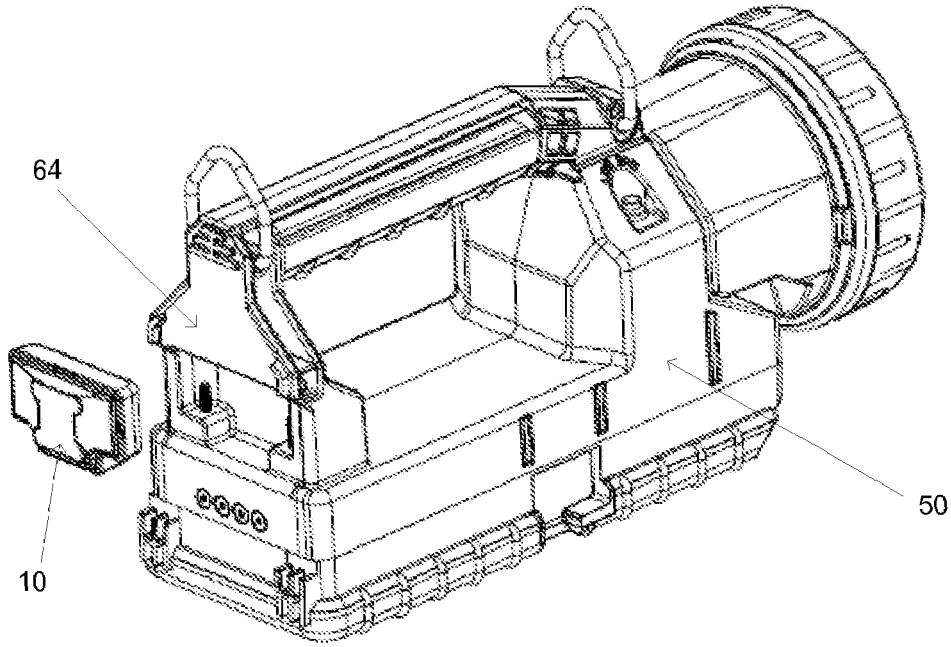
FIG. 1 is a perspective view of a module detached from a flashlight body, in accordance with an embodiment of the invention.
Figure 2:
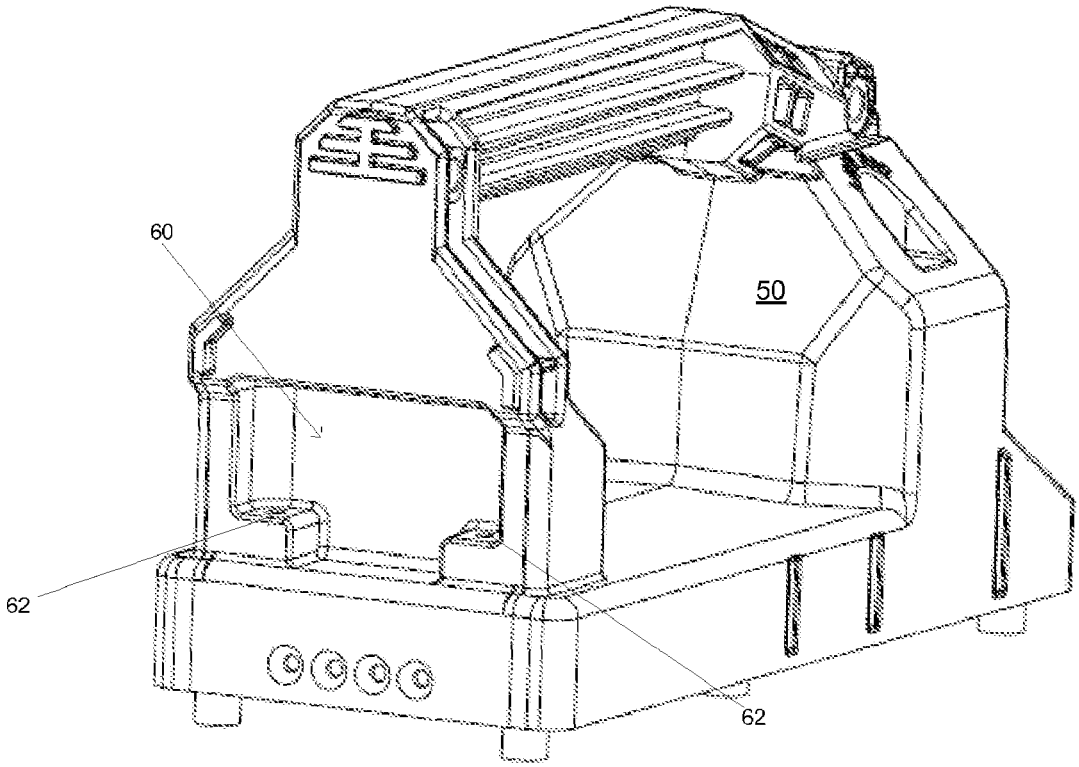
FIG. 2 is a perspective view of flashlight body with a pocket for receiving a module, in accordance with an embodiment of the invention.
Figure 5:
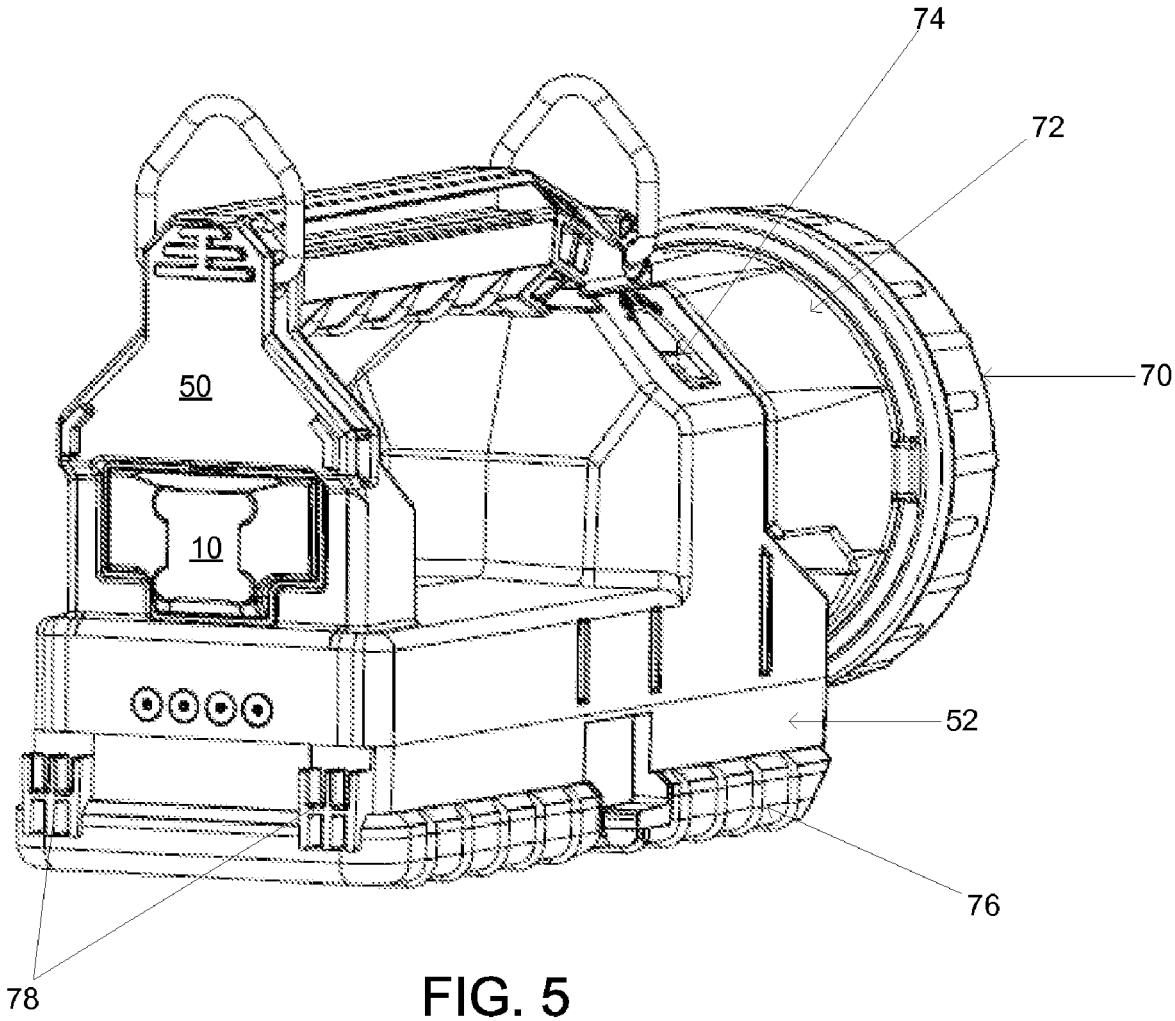
FIG. 5 is a perspective view of a module and a flashlight, in accordance with an embodiment of the invention.

A preferred flashlight of the present invention has a body 52, as shown in FIGS. 1, 2, and 5. A flashlight of the present invention, however, is not limited to the flashlight as show in FIGS. 1, 2, and 5 but instead can have any particular body shape, size, configuration, or assembly.

Where a power source is located within the body of the flashlight, the power source may be any suitable power source or device known in the art, such as a battery. A particularly preferred power source is a lithium-ion battery. Alternatively, in a varying embodiment, the power source may be contiguous to the body of the flashlight, but need not be located within the body; for example and without limitation, the power source could be located contiguous to the outer surface of the body.

Where a power source is located within the module, the power source located within the module also may be any suitable power source or device known in the art.

The present invention also includes a flashlight comprising a first power source (whether contiguous to or within the body of the flashlight) and a module that has its own independent second power source.

Figure 3:
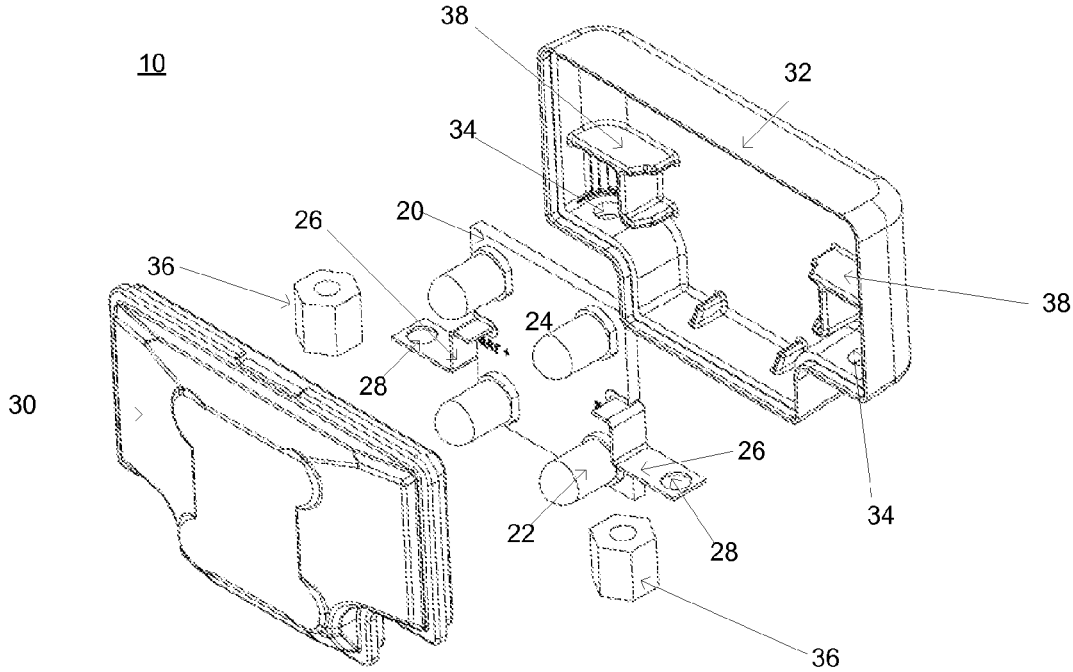
FIG. 3 is an exploded view of a module, in accordance with an embodiment of the invention.
Figure 4:
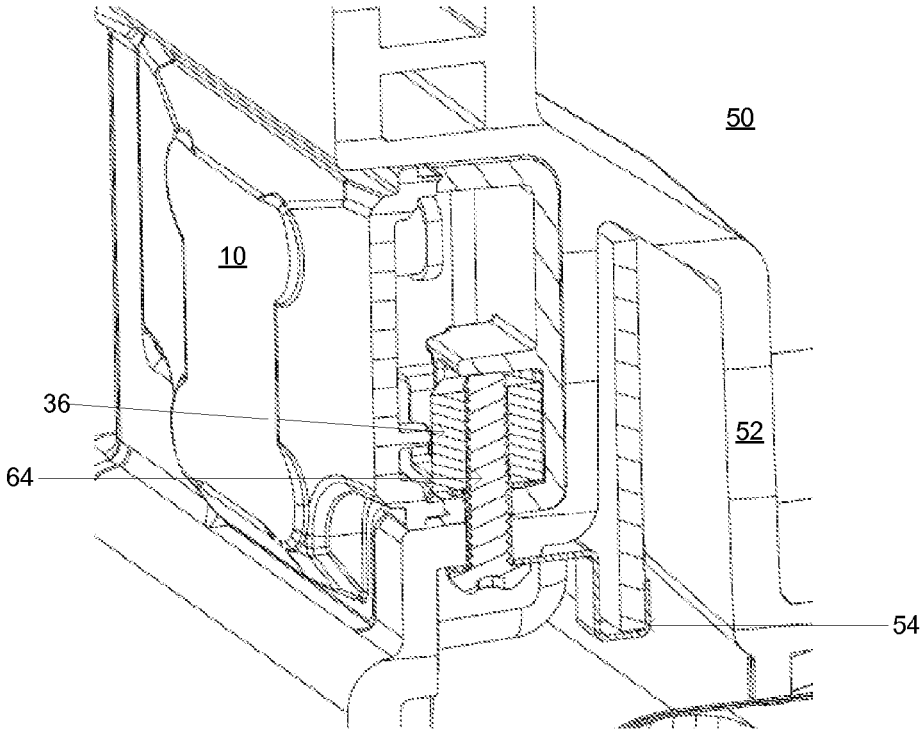
FIG. 4 is a cut-away view of a module within a pocket of a flashlight, in accordance with an embodiment of the invention.

A preferred module is an LED lighting module 10, as shown in FIGS. 3 and 4. A module of the present invention, however, is not limited to a particular shape, size, configuration, or assembly. Nor is a module of the present invention limited to a lighting module. The module may perform any function, and is preferably selected from the group consisting of a lighting module, a GPS navigation module, a tracking module, a natural gas detection module, and a radio module, although a lighting module is particularly preferred, and an LED lighting module is even more preferred.

Preferably, the module is contiguous to any region on the outer surface of the body of the flashlight, and even more preferably, the module is contiguous to either a rear end of the flashlight or a side of the flashlight.

Preferably, the module will be attached or connected to any region on the outer surface of the body of the flashlight. The attachment or connection may be permanent or semi-permanent. The module is preferably removeably attached or connected (with or without any degree of destruction of the module or any parts or surfaces to which it is attached or connected, but preferably without any such degree of destruction). Any known connection or attachment elements or techniques known in the art may be utilized. Preferably, when the flashlight contains a power source (whether contiguous to or within the body of the flashlight) for powering the module, connection or attachment elements or techniques are employed, such that the module receives power from the power source through the connection or attachment elements or the connection or attachment structure resulting from the particular technique that was employed.

In another preferred embodiment, a flashlight may comprise more than one module. A flashlight may comprise, for example and without limitation, a first module that is contiguous to the rear end of the flashlight and a second module that is contiguous to a side of the flashlight. Alternatively, a flashlight may comprise, as another non-limiting example, at least one module that is contiguous to one side of the flashlight and at least one additional module that is contiguous to another side of the flashlight. As another preferred alternative, a flashlight may comprise at least one module that is contiguous to the rear end of the flashlight and at least one additional module that is contiguous to the front end of the flashlight (and optionally at least one further module that is contiguous to at least one side of the flashlight).

In yet another preferred embodiment, a flashlight may comprise a primary lamp of any suitable kind known in the art. The primary lamp may be contiguous to any region on the outer surface of the body of the flashlight, in combination with, but irrespective of, the location of any module. A preferred primary lamp is a main lamp assembly 72, as shown in FIG. 5, which is further described below.

In a particularly preferred embodiment, the outer surface of the body of the flashlight defines a pocket or recess, and the module is contiguous to said pocket or recess. In one embodiment, as shown in FIGS. 2, 4, and 5, the outer surface defines a pocket or recess 60, which is configured to receive in a substantially complementary manner a lighting module 10, such that the module is contiguous (preferably attached or connected, even more preferably removably attached or connected) to the pocket or recess. As used herein, "pocket" or "recess" does not encompass a hole or opening in the outer surface of the body of the flashlight. However, alternatively, the outer surface of the body of the flashlight may comprise a hole or opening which is configured to receive the module in a substantially complementary manner, such that the module is contiguous (preferably attached or connected) to the hole or opening.

Turning now to specific preferred embodiments as shown in the FIGS. 1-5.

One embodiment of a module 10 is generally shown in FIGS. 1 and 5 in connection with a flashlight 50. The flashlight 50 is characterized by the main body portion 52 having a pocket or recess 60 into which a module 10, which is a lighting module, is adapted to fit, as is also shown in FIG. 2.

The module 10 is shown in more detail in an exploded view in FIG. 3. The module 10 is comprised of a light source 20, inserted between front 30 and back 32 covers. As is well understood in the art, at least a portion of front cover 30 should be transparent or translucent to light. Light source 20 is comprised of at least one light emitting diode (LED) 22 connected to a circuit board 24. Other light sources known in the art, such as incandescent lights, may be used in place of the LEDs 22 and/or the circuit board 24. Light source 20 has positive and negative electrical contacts 26 connected thereto. The light source 20 is then placed on either of covers 30 or 32. In this embodiment of the invention, the electrical contacts 26 comprise apertures 28 that are matched to mounting apertures 34 in the back cover 32. While mounting apertures 34 are shown here located on the bottom of the cover, other positions, such as in the front cover, may be used. Retention nuts 36 or similar connection or attachment elements are lined up with the apertures 28 of the electrical contacts 26 and the mounting apertures 34 in this embodiment.

To assist the process of retaining the light source 20 and retention nuts 36, the back cover 32 is shown in FIG. 3 with retention clips 38 into which the light source 30 and retention nuts 36 are frictionally retained. The module 10 assembly is completed by sealing the front cover 30 to the back cover 32, with the light source 20 retained therein. In one embodiment of the invention, the covers 30, 32 are constructed of polycarbonate or other thermoplastic resin and ultrasonically welded together. Other materials and sealing or attachment techniques known in the art may be utilized. As one such example, the back cover can be constructed of nylon and the two covers attached together by screws. Further, it has been found that the use of a lip on one of the covers facilitates mating of the two covers together.

Referring to FIG. 2, a pocket or recess 60 has a plurality of apertures 62 that correspond in position to mounting apertures 34. In one embodiment of the invention, as shown in FIG. 4, the module 10 is secured to the main body portion 52 of the flashlight 50 by fastening screws 64 or similar fasteners that are placed from within the main body portion 52, through the underside of apertures 62, mounting apertures 34, contacts 26 and retaining means 36. Fastening screws 64, also shown in FIG. 1, are electrically conductive. As can be seen in FIG. 4, fastening screws 64 conduct electrical power and control from the main body 52 of the flashlight 50 (and constituent parts) to the module 10 through contact 54, which may be a wire, conductive plate, or other similar conductor known in the art. The flashlight 50 with the light source 10 mounted therein is shown in FIG. 5. In another embodiment of the invention, the fastening screws 64 or similar fasteners can be directly molded in situ with the body 52 of the flashlight.

In an alternative embodiment of the invention, the module 10 is attached or connected to the flashlight 50 without screws or similar semi-permanent fasteners, but rather metal snaps on either of covers 30, 32 comprising the module housing that mate with detents in the flashlight housing. The metal snaps could double as the electrical contacts to power and retain the module in the flashlight housing. Plastic snaps may also be used, with the provision of separate electrical contacts on the module. The configuration as shown in FIG. 2 can readily be converted to such a configuration by replacing the existing fastening screws 64 with pins molded into or otherwise fastened to the flashlight housing in the same location and orientation as the disclosed screws. The module is then modified in this embodiment to create u-shaped slot features to mate the aforementioned electrical contacts with the aforementioned electrical contact pins. A retractable lever or spring-loaded detent mechanism could be utilized to securely retain the module on the pins in the recessed pocket of the flashlight housing. With this readily detachable module arrangement, one can provide a power take-off cord that can be plugged into the recessed pocket of the flashlight body. This cord would mate mechanically and electrically with the contact pins providing a method to power auxiliary equipment such as a gas detector or remote/flexible work light or headlamp.

One advantage of the present invention is the ability to replace readily an installed module with another identical module, for example, in the event of damage. In one embodiment of the invention, when LEDs are the light source 22, they can be used to signal the user's location through continuous illumination or a blinking, flashing or other pattern. The ready replacement of modules allows one to replace easily one LED lighting module with another, different module that has different colored LEDs or non-flashing LEDs, or with another type of lighting module for purposes other than signaling one's location. For instance, an alternate lighting module may function as an area work light projecting light over a larger area but at close proximity to the flashlight, complementing the tightly focused main light beam of the main flashlight light. The instant invention is also adapted in further embodiments for accepting other non-lighting modules, such as radios, natural gas detectors, tracking systems, GPS navigation systems, and power take-offs, and generally, any type of module having a designated function. The power take-off module is particularly useful in combination with a battery/power protection circuit.

A flashlight of the present invention can optionally have one or more of the following additional features:

Optionally, a rotateable main light source 70, wherein the main lamp assembly 72 is waterproof and connected to the body/battery 52 compartment by clamping the pivot-points on the main lamp housing between the upper and lower halves of the body/battery compartment, as shown in FIG. 5. When in the home position, the light 70 faces directly forward. The main lamp assembly 72 can be rotated towards the bottom of the light from the home position; in one embodiment up to 100 degrees. When a fixed main lamp assembly is desired, the flashlight can be configured with additional components that lock the main lamp assembly in the home position. In addition the main lamp assembly, pivot-points protrude through replaceable pivot sleeves with integral detents and replaceable wear plates that prevent the main lamp assembly from rotating freely, thus locating the head in a plurality of useful angles for simple hands free use. Further usefulness is gained from the balance of the complete assembly that allows it to be stood on its back end stabilized by several small protrusions on the rear facing walls of the flashlight.

Optionally, an activation switch located adjacent to the head assembly in a recessed portion of the body that prevents accidental activation of the switch yet still is convenient to turn on purposely. The ratio of the exposed length of the switch activator to the depth of the body recess in which it resides is preferably less than one.

Optionally, a main activation switch for ordinary on/off functions, preferably connected in such a way as to completely disconnect a battery (such as lithium-ion) protection circuit from all external loads, for the purpose of resetting the protection circuit after occurrence of a protection event, such as a short circuit, over/under current condition, or a over/under voltage condition. It is believed that completely disconnecting the battery circuit from all external loads is the only way to reset conventional protection circuits.

Optionally, a separate replaceable shock-absorbing rubber bottom 76 that completely covers the bottom and a portion of the sides of the flashlight protecting the unit from damage due to dropping, as shown in FIG. 5. This rubber bottom 76 also may provide a non-slip surface allowing the flashlight to be positioned on angled smooth surfaces for hands-free operation.

Optionally, a ratio of the charge time to discharge time of one or less than one. The end user of this product can expect this flashlight to discharge for at least as long a time as it was charged. This enables professional emergency personnel to respond quickly to consecutive incidents with minimal charge time required between events.

Optionally, recessed key-shaped features 78 on the body 52 of the flashlight, as shown in FIG. 5, to lock the flashlight into a charging/storage cradle. This is an advantage over similar lights in that this feature allows the bottom of the flashlight to be flat, aiding emergency personnel when using the light to crawl through hazardous areas (for example, firemen in particular often crawl through burning structures). Similar flashlights have external protrusions designed to lock into the recesses of a charging cradle. These protrusions are often subject to damage from dropping and can become snagged on debris encountered during emergency situations. The flat bottom of a flashlight of the present invention allows full contact with the non-slip rubber bumper 76, above, providing greater stability when crawling or balancing the flashlight on uneven surfaces during hands-free operation.

Optionally, a low battery indicator that uses a microprocessor to interpret battery voltage, temperature effects and load effects on 4, 6 or 8-cell li-ion battery packs, for example. Low voltage is signaled through use of a low power LED 74, as shown in FIG. 5. This LED 74 will activate when approximately 30 minutes of runtime is remaining for the main lamp. This indicator provides additional convenience/safety for emergency personnel to evacuate from remote or hazardous locations.

Optionally, a less than one ratio of the weight of the flashlight to weight of the amount of water displaced by the flashlight, thus allowing the flashlight to float in water. Since a flashlight of the present invention is preferably waterproof, it will continue to float indefinitely. The light weight, small profile, high powered characteristics of this flashlight are accomplished through the use of lithium-ion batteries combined with modern, injection-molded engineered plastics.

Optionally, a main lamp reflector comprised of a highly focused parabolic shape with a flat-matte finish in the bottom portion where the bulb resides. This flat-matte finished area improves the quality of the light pattern by reducing the dark shadows and "rings" commonly generated by incandescent light sources combined with a polished parabolic reflector.

Optionally, a main body construction wherein the main body halves form a battery compartment that securely captures and fixes the battery in place eliminating the need for additional components to restrain the battery.

The foregoing description of the instant invention and the accompanying drawings is illustrative. Other modifications and variations can be made to the instant invention without diverging from the scope, spirit, or teaching of the invention.

What is claimed is:

1. A flashlight comprising:

a body having an outer surface;

a power source located within said body;

a module, wherein said module is removable from and contiguous to said outer surface and said module receives power from said power source; and at least one connection element, said module removably secured to said outer surface by said at least one connection element, and said module receives power from said power source through said at least one connection element.

2. The flashlight of claim 1, wherein said module is selected from the group consisting of a lighting module, a GPS navigation module, a tracking module, a natural gas detection module, and a radio module.

3. The flashlight of claim 1, wherein said module comprises a lighting module.

4. The flashlight of claim 1, wherein said outer surface defines a pocket or recess and said module is contiguous to said pocket or recess.

5. The flashlight of claim 1, wherein said outer surface comprises an opening or hole and said module is contiguous to said opening or hole.

6. The flashlight of claim 4, wherein said module is attached to said pocket or recess.

7. The flashlight of claim 6, wherein said module is removeably attached to said pocket or recess.

8. The flashlight of claim 5, wherein said module is attached to said opening or hole.

9. The flashlight of claim 8, wherein said module is removeably attached to said opening or hole.

10. The flashlight of claim 1, wherein said flashlight further comprises a primary lamp contiguous to said body.

11. The flashlight of claim 10, wherein said flashlight has a front end and a rear end, said primary lamp is contiguous to said body at said front end, and said module is contiguous to said rear end.

12. The flashlight of claim 1 wherein the connection element includes a screw.

13. The flashlight of claim 1 wherein the connection element includes a pin.

14. The flashlight of claim 4 wherein the module includes a power take-off cord adapted to removably engage the recess and power auxiliary equipment.

15. A flashlight comprising:

a body having an outer surface;

a power source located within said body;

a module, wherein said module is removable from and contiguous to said outer surface and said module receives power from said power source;

a front end, a rear end, and at least one side located between said front end and said rear end, and said module is contiguous to said rear and a second module contiguous to said at least one side.

16. The flashlight of claim 15 wherein said flashlight further comprises a primary lamp contiguous to said body.

17. A flashlight comprising:

a body having an outer surface;

a power source located within said body;

a module, wherein said module is removable from and contiguous to said outer surface and said module receives power from said power source; and a front end, a rear end, and at least one side located between said front end and said rear end, and said module is contiguous to said at least one side.

18. The flashlight of claim 17, wherein said flashlight further comprises a primary lamp contiguous to said body.

* * * * *